US009919844B2

(12) United States Patent
Taylor

(10) Patent No.: US 9,919,844 B2
(45) Date of Patent: Mar. 20, 2018

(54) SEALABLE BAG

(71) Applicant: Peter Taylor, Caledon (CA)

(72) Inventor: Peter Taylor, Caledon (CA)

( * ) Notice: Subject to any disclaimer, the term of this patent is extended or adjusted under 35 U.S.C. 154(b) by 0 days.

(21) Appl. No.: 15/300,840

(22) PCT Filed: Apr. 2, 2015

(86) PCT No.: PCT/CA2015/050267
§ 371 (c)(1),
(2) Date: Sep. 30, 2016

(87) PCT Pub. No.: WO2015/149183
PCT Pub. Date: Oct. 8, 2015

(65) Prior Publication Data

US 2017/0015471 A1 Jan. 19, 2017

Related U.S. Application Data

(60) Provisional application No. 61/974,038, filed on Apr. 2, 2014.

(51) Int. Cl.
*B65D 33/16* (2006.01)
*B65D 33/18* (2006.01)
*B65D 33/14* (2006.01)

(52) U.S. Cl.
CPC ..... *B65D 33/18* (2013.01); *B65D 33/14* (2013.01)

(58) Field of Classification Search
CPC ..... B65D 33/18; B65D 33/14
USPC ..... 383/62, 84, 86, 93, 95, 86.1, 86.2; 229/80
See application file for complete search history.

(56) References Cited

U.S. PATENT DOCUMENTS

| | | | | | |
|---|---|---|---|---|---|
| 2,861,735 | A | | 11/1958 | Faltin | |
| 2,991,001 | A | * | 7/1961 | Hughes | B65D 33/20 383/210.1 |
| 4,192,448 | A | * | 3/1980 | Porth | B65D 27/14 229/80 |
| 4,633,508 | A | | 12/1986 | Sanders | |
| 5,476,323 | A | * | 12/1995 | Gold | B65D 33/18 229/80.5 |

(Continued)

FOREIGN PATENT DOCUMENTS

| | | | | |
|---|---|---|---|---|
| FR | 2688194 A1 | * | 9/1993 | B65D 33/20 |
| GB | 2265883 | | 10/1993 | |

*Primary Examiner* — Jes F Pascua
(74) *Attorney, Agent, or Firm* — DeLio, Peterson & Curcio, LLC; Thomas E. Ciesco

(57) ABSTRACT

A bag has a tubular edge portion defining an open end, the edge portion being defined by two elongate parts. Adhesive is disposed upon one of the parts and is adapted to grip the other of the parts. A strip extends from the open end to a terminus disposed interiorly of the bag, is adhesively secured to the one part in overlying relation to the adhesive and has apertures thereby defining areas of exposed adhesive. A lip has a release portion that extends from the terminus and is frangibly connected thereto, the release portion being disposed in overlying relation to the strip, to isolate the other of the parts from the areas of exposed adhesive and has an adhesive resistant surface to permit the lip to be detached via the frangible connection, thereby to permit closure by adhesion of said other of the parts to the areas of exposed adhesive.

9 Claims, 5 Drawing Sheets

(56) References Cited

U.S. PATENT DOCUMENTS

| | | | | |
|---|---|---|---|---|
| 5,620,256 | A * | 4/1997 | Makrauer | B65D 33/1691 383/5 |
| 7,033,077 | B2 | 4/2006 | Taylor | |
| 2004/0013322 | A1 | 1/2004 | Taylor | |

* cited by examiner 20
26
44
28
38
42
40
30
34A
34B
48
46
36
24
22

44
28
42
30
50
26
34A
34
34B
38
36
24
32

40
34B

SEALABLE BAG

FIELD OF THE INVENTION

The present invention relates to bags and, in particular, to bags having a mechanism or device for closing or sealing same.

BACKGROUND OF THE INVENTION

Bags of the sealable and resealable types are widely used. One known sealable bag is described in U.S. Pat. No. 7,033,077, incorporated herein by reference.

SUMMARY OF THE INVENTION

Forming one aspect of the invention is a bag assembly. This bag assembly comprises a bag, an adhesive, a strip and a bag lip. The bag has an open end and a tubular edge portion abutting and defining the open end, the tubular edge portion being defined by two elongate parts connected in end-to-end relation. The adhesive is disposed interiorly of the bag upon one of the elongate parts and is adapted to adhesively grip the other of the elongate parts. The strip extends, from the open end of the bag, to a terminus disposed interiorly of the bag. The strip circumscribes, abuts and is adhesively secured to the one of the elongate parts in overlying relation to the adhesive. The strip further has defined therein apertures, thereby defining areas of exposed adhesive. The bag lip projects exteriorly of the bag and has a release portion that extends from the terminus of the strip and is frangibly connected thereto. The release portion is disposed between the strip and the other of the elongate parts to isolate the other of the elongate parts from the areas of exposed adhesive. The release portion further has a surface resistant to the adhesive, to permit the bag lip to be detached via the frangible connection and drawn from the bag, thereby to permit closure of said open mouth by adhesion of said other of the elongate parts to the areas of exposed adhesive.

According to another aspect of the invention, the bag has a closed bottom end.

According to another aspect of the invention, the bag lip forms a wicket lip suitable for placement of said bag on wicket wires.

According to another aspect of the invention, the bag is made of plastic film having a substantially uniform thickness of between about 1 mil and about 4 mil.

According to another aspect: the release portion can be disposed between the strip and the other of the elongate parts to isolate the other of the elongate parts from the areas of exposed adhesive; and closure of the bag can be provided by drawing the interior surfaces of the elongate parts together.

According to another aspect, the bag can be adapted such that, when wicket portion is removed, the one elongate part protrudes beyond the other elongate part, whereby closure of the bag can be provided by folding the one elongate part over the other, elongate part and securing the adhesive to the outer surface of the other elongate part.

Other advantages, features and characteristics of the invention will be apparent to persons of ordinary skill upon a review of the detailed description, claims and drawings, the latter being briefly described hereinafter.

DETAILED DESCRIPTION

Figure 1:
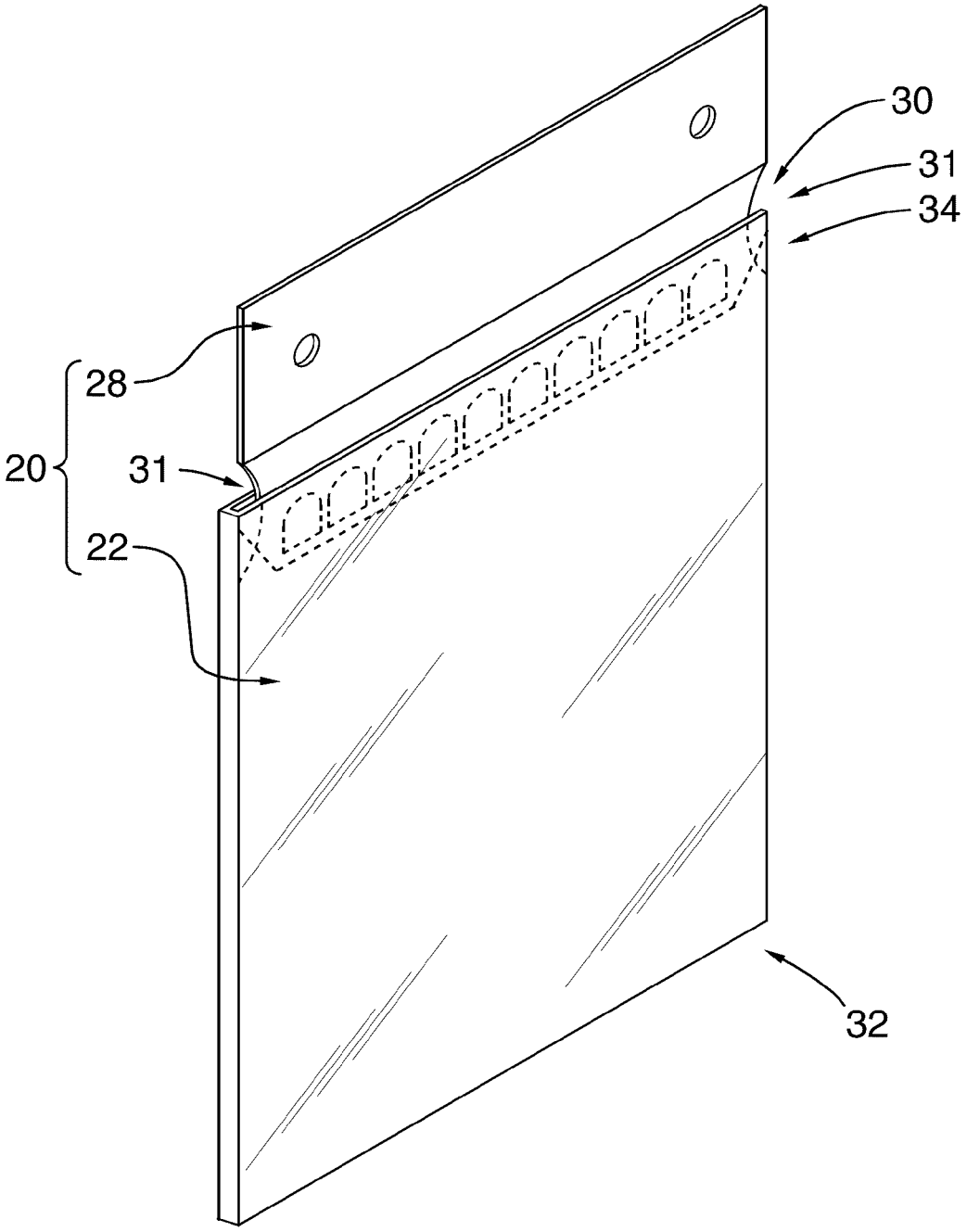
FIG. 1 is a perspective view of a bag assembly according to an exemplary embodiment of the invention, the bag thereof being in an open configuration
Figure 2:
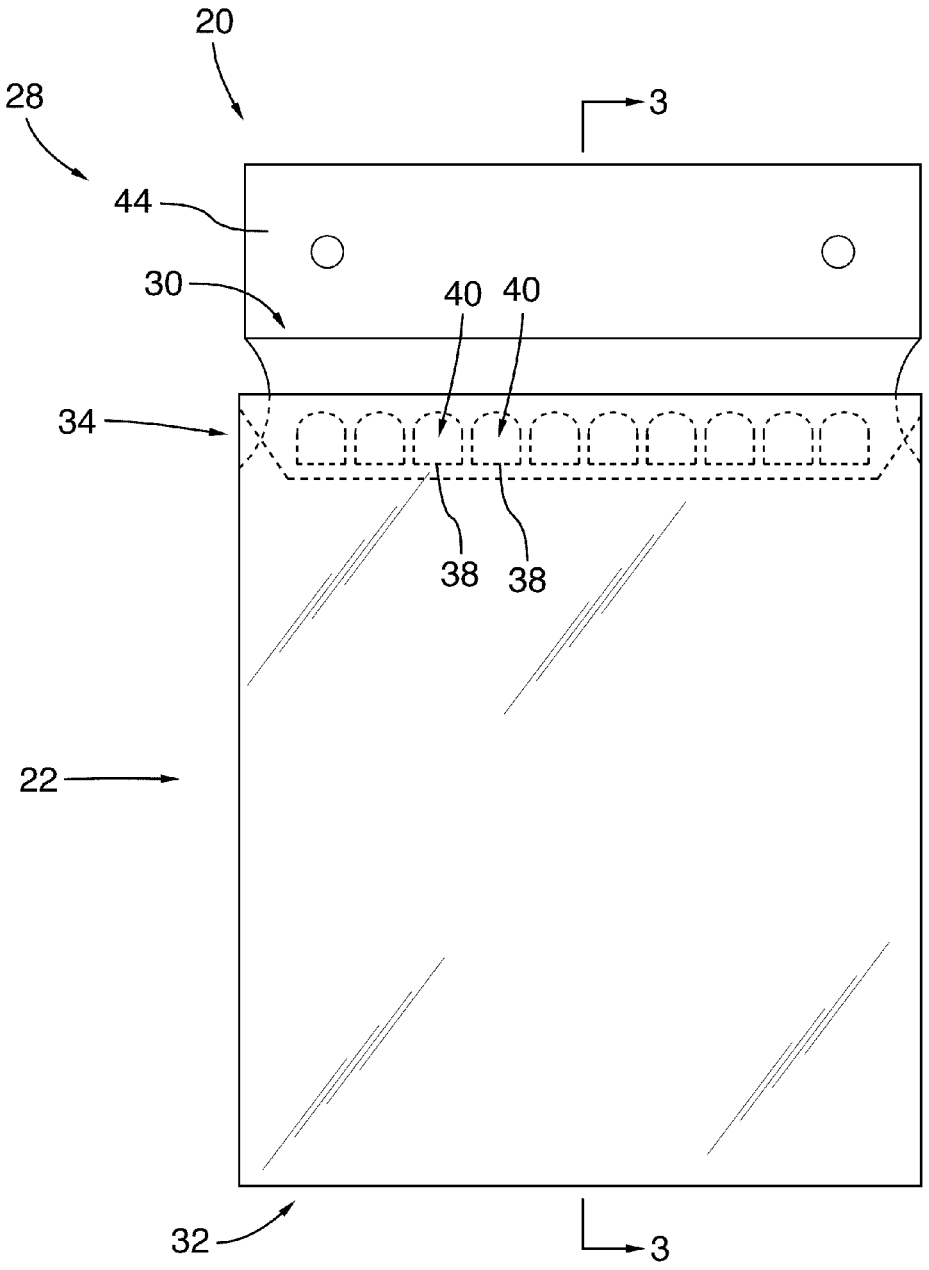
FIG. 2 is a front plan view of the bag assembly of FIG. 1.

The bag assembly 20 shown in FIGS. 1-5 will be seen to include a bag 22, an adhesive 24, a strip 26 and a bag lip 28.

The bag 22 is made of plastic film having a substantially uniform thickness of about 1 mil and has a top end 30, a bottom end 32 and an edge portion 34. The top end 30 is shown open in FIGS. 1-4. The bottom end 32 is closed. The edge portion 34 defines the top end 30, is tubular and will be seen in FIG. 1 to be defined by two elongate parts 34A,34B connected in end-to-end relation and arranged in substantially parallel relation to one another.

The adhesive 24 is disposed interiorly of the bag upon one 34A of the elongate parts and is adapted to adhesively grip the other 34B of the elongate parts.

The strip 26: will be seen in FIG. 1 to extend, from the top end of the bag, to a terminus 36 disposed interiorly of the bag; circumscribes, abuts and is adhesively secured to the one 34A of the elongate parts in overlying relation to the adhesive 24; and has defined therein apertures 38 thereby defining areas 40 of exposed adhesive.

The bag lip 28 has a release portion 42 and a wicket portion 44.

The wicket portion 44 is suitable for placement of said bag on wicket wires (not shown).

Figures 3, 4, 5:
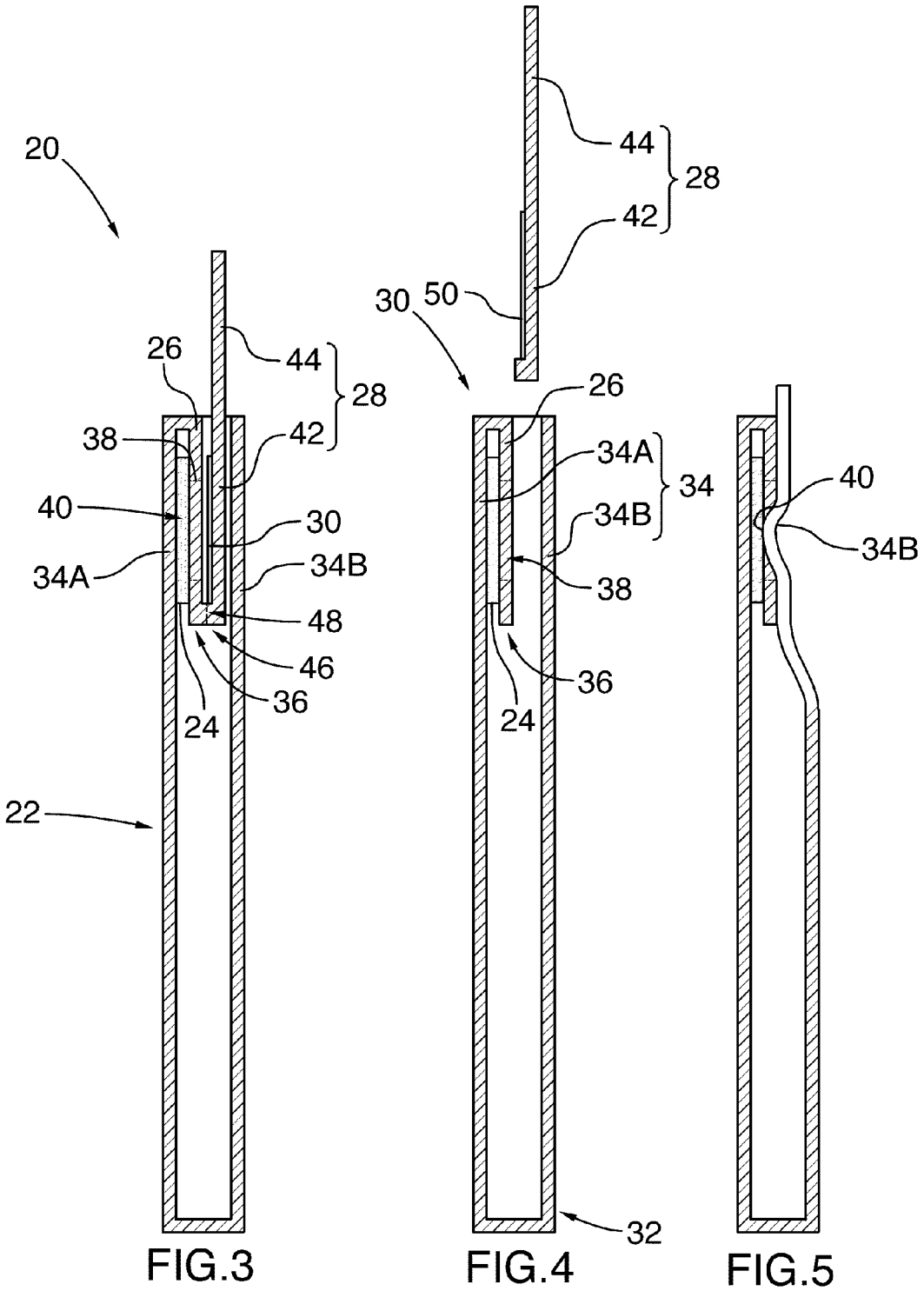
FIG. 3 is a view along section 3-3 of FIG. 1.
FIG. 4 is a view similar to FIG. 3, with the bag lip detached.
FIG. 5 is a view similar to FIG. 4, with the bag shown in the closed configuration.

The release portion 42 extends from the terminus 36 of the strip 26 to the wicket portion 44, is connected to the terminus 36 of the strip in a frangible manner, to wit, by a portion 46 of the plastic that has a plurality of perforations 48 defined therein, and will be seen to be disposed between the strip 26 and the other 34B of the elongate parts, to isolate the other 34B of the elongate parts from the areas 40 of exposed adhesive 24. The release portion 42 will further be understood to have a surface 50 resistant to the adhesive 24. This permits the bag lip 28 to be detached, via the frangible connection, and drawn from the bag, as shown in FIG. 4, thereby to permit closure of top end by adhesion of said other 34B of the elongate parts to the areas 40 of exposed adhesive 24, as shown in FIG. 5.

Persons of ordinary skill will understand the structure to be of significant advantage.

As one advantage, the structure can be constructed using conventional converting equipment. Persons of ordinary skill in the art will be readily able to produce the structure using conventional converting techniques; accordingly, details are neither provided nor required, but it will be noted that notches 31 are usefully provided.

Figure 9:
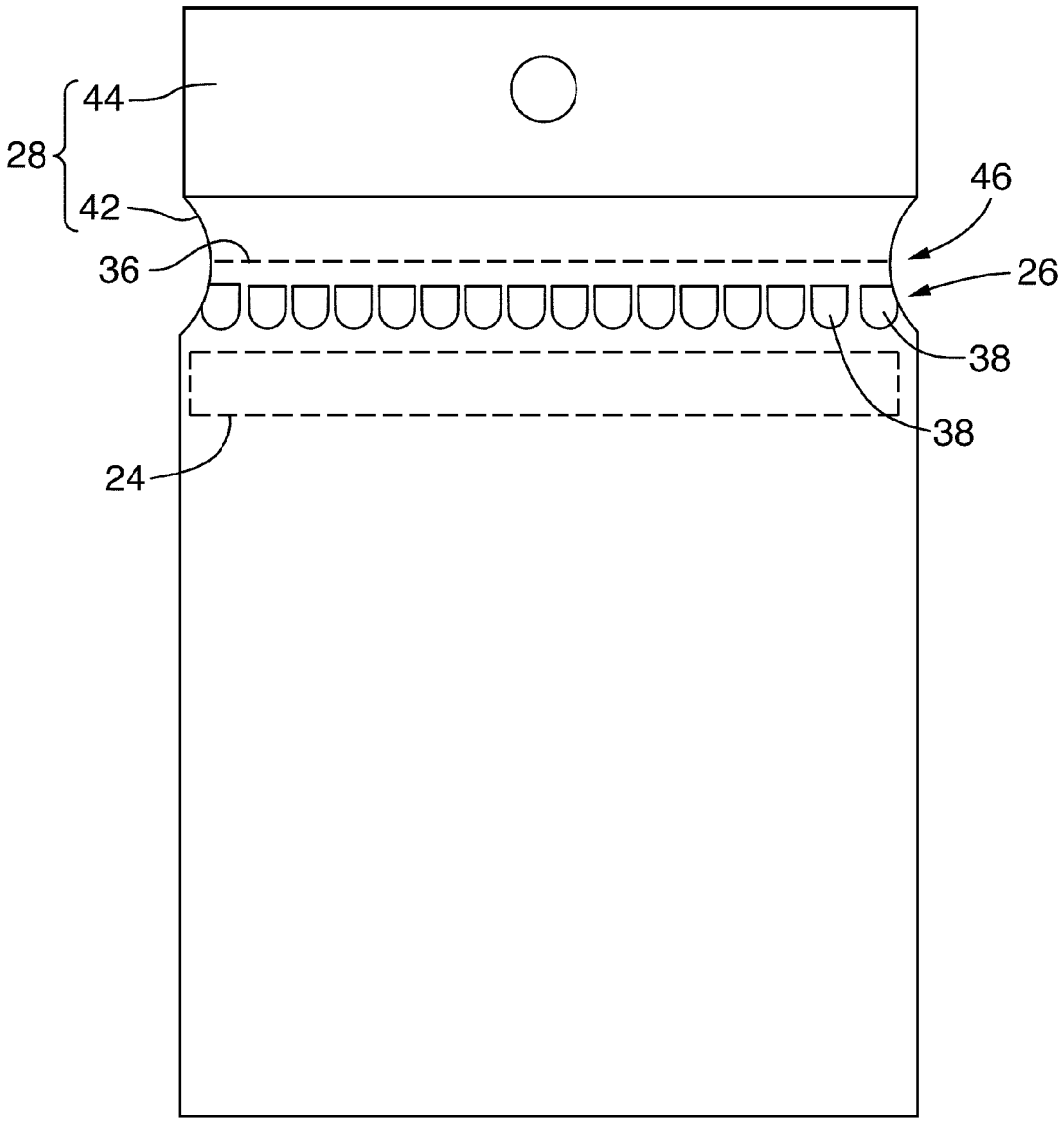
FIG. 9 is a view of the structure of FIGS. 1-5, in an unfolded configuration.

By way of further assistance, a face view illustration of the film set-up of the structure of FIG. 1-5 is shown in FIG. 9. For greater clarity, the pattern mask is shown flat in relation to the adhesive and the release strip.

As another advantage, the release layer is disposed on the side of the film that, in use, forms the outside of the bag; this means that the release layer does not need to be suitable for contact with food, and also can be applied as part of the bag printing operation, with commensurate cost impacts.

As another advantage, the strip, which remains on the bag after detachment of the bag lip portion, adds strength to the lip of the bag, which has advantage in terms of opening and reclosing of the bag, especially in the context of thinner films and bags having adhesive intended for multiple reclosures.

Figure 6:
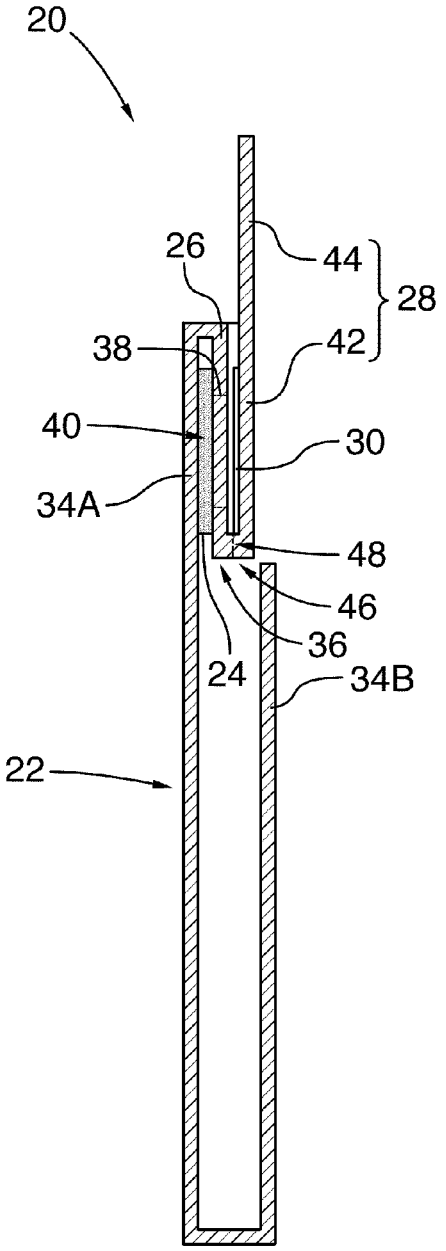
FIG. 6 is a view similar to FIG. 3, showing an alternate embodiment.
Figure 7:
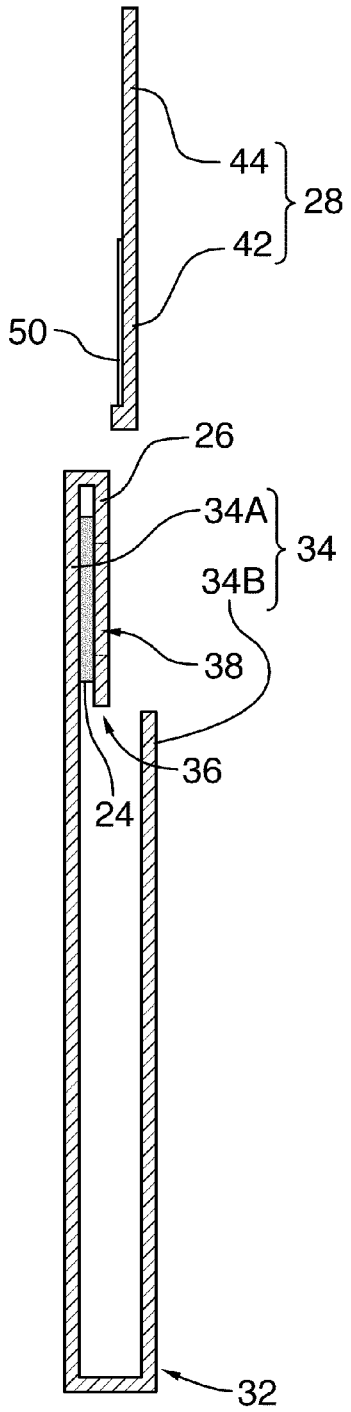
FIG. 7 is a view similar to FIG. 4, of the alternate embodiment of FIG. 3.
Figure 8:
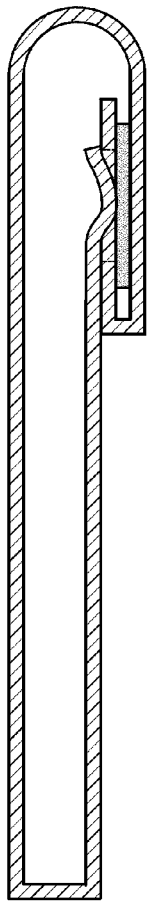
FIG. 8 is a view of the structure of FIG. 7, in a closed configuration.

A second exemplary embodiment is shown in FIG. 6 through FIG. 8. In this embodiment, it will be noted that the elongate part 34B is sized such that, when wicket portion 44 is removed, the areas of exposed adhesive 40 protrude lie beyond the elongate part 34B, thereby to allow that part of the structure carrying the adhesive 40 to be folded over and against the elongate part 34B. This provides a self-sizing resealable bag.

Whereas but two embodiments are herein shown and described, variations are possible.

For example only, whereas apertures of a specific size and shape are shown, the size, shape and placement of the apertures in the release portion can be adjusted, with commensurate impacts on bag closure/adhesion, without modification to the adhesive used.

Further, whereas in the exemplary embodiment, a bag thickness of about 1 mil is mentioned, thicknesses of 0.8 mil to 4 mil are known to be useful.

As well, whereas a wicket structure is shown in FIGS. 1-5, bags can be grouped via other methods such as heat pinning, card packing and twist tie. As well, the end-user can also fill and close single bags.

Accordingly, the invention should be understood to be limited only by the accompanying claims, purposively construed.

The invention claimed is:

1. A bag assembly, the bag assembly comprising:

a bag having an open end and a tubular edge portion abutting and defining the open end, the tubular edge portion being defined by two elongate parts connected in end-to-end relation;

an adhesive disposed interiorly of the bag upon one of the elongate parts and adapted to adhesively grip the other of the elongate parts;

a strip extending, from the open end of the bag, to a terminus disposed interiorly of the bag, the strip circumscribing, abutting and being adhesively secured to the one of the elongate parts in overlying relation to the adhesive; and having defined therein apertures thereby defining areas of exposed adhesive; and a bag lip projecting exteriorly of the bag and having a release portion that extends from the terminus of the strip and is frangibly connected thereto, the release portion being disposed in overlying relation to the strip, to isolate the other of the elongate parts from the areas of exposed adhesive and having a surface resistant to the adhesive, to permit the bag lip to be detached via the frangible connection and drawn from the bag, thereby to permit closure of said open mouth by adhesion of said other of the elongate parts to the areas of exposed adhesive.

2. A bag according to claim 1 wherein said bag has a closed bottom end.

3. A bag according to claim 1 wherein said bag lip has a wicket portion suitable for placement of said bag assembly on wicket wires.

4. A bag according to claim 1 wherein said bag is made of plastic film having a substantially uniform thickness of about 1 mil.

5. A bag according to claim 1, wherein the adhesive and the apertures are adapted to provide for a permanent closure of the bag.

6. A bag according to claim 1, wherein the adhesive and the apertures are adapted to render the bag reclosable.

7. A bag according to claim 1, wherein perforations are provided to provide for the frangible connection.

8. A bag according to claim 1, wherein: the release portion is disposed between the strip and the other of the elongate parts to isolate the other of the elongate parts from the areas of exposed adhesive; and closure of the bag is provided by drawing the interior surfaces of the elongate parts together.

9. A bag according to claim 1, further adapted such that, when wicket portion is removed, the one elongate part protrudes beyond the other elongate part, whereby closure of the bag can be provided by folding the one elongate part over the other elongate part and securing the adhesive to the outer surface of the other elongate part.

* * * * *